US005962808A

United States Patent [19]

Lundstrom

[11] Patent Number: 5,962,808

[45] **Date of Patent: *Oct. 5, 1999**

[54] GAS GENERANT COMPLEX OXIDIZERS

[75] Inventor: Norman H. Lundstrom, Tacoma, Wash.

[73] Assignee: Automotive Systems Laboratory, Inc., Farmington Hills, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,694

[22] Filed: Mar. 5, 1997

[51] Int. Cl.[6] ..... C06B 45/10; C06B 31/00

[52] U.S. Cl. ..... 149/19.1; 149/22; 149/36; 149/37; 149/38; 149/41; 149/43; 149/45; 149/46; 149/61; 149/62; 149/77; 149/78; 149/47

[58] Field of Search ..... 149/36, 45, 19.1, 149/22, 37, 38, 41, 43, 46, 61, 62, 77, 78, 47

[56] References Cited

U.S. PATENT DOCUMENTS

| | | | |
|---|---|---|---|
| 2,220,891 | 11/1940 | Cook et al. | 52/14 |
| 2,220,892 | 11/1940 | Cook et al. | 53/19 |
| 2,222,175 | 11/1940 | Hauff et al. | 52/14 |
| 3,463,684 | 8/1969 | Dehu | 149/45 |
| 3,673,015 | 6/1972 | Sollott et al. | 149/29 |
| 4,336,085 | 6/1982 | Walker et al. | 149/45 |
| 5,160,386 | 11/1992 | Lund et al. | 149/88 |
| 5,266,132 | 11/1993 | Danen et al. | 149/15 |
| 5,460,669 | 10/1995 | Willer et al. | 149/92 |
| 5,472,535 | 12/1995 | Mendenhall et al. | 149/36 |
| 5,518,054 | 5/1996 | Mitson et al. | 149/35 |
| 5,542,704 | 8/1996 | Hamilton et al. | 280/741 |
| 5,592,812 | 1/1997 | Hinshaw et al. | 60/205 |

FOREIGN PATENT DOCUMENTS

| | | |
|---|---|---|
| 544582 | 8/1940 | United Kingdom . |
| WO 95/04016 | 2/1995 | WIPO . |
| WO 95/19944 | 7/1995 | WIPO . |
| WO98/06486 | 2/1998 | WIPO . |

*Primary Examiner*—Edward A. Miller
*Attorney, Agent, or Firm*—Lyon, P.C.

[57] ABSTRACT

Nonazide gas generant compositions, useful for inflating passenger restraint gas inflator bags, comprise a multimetallic coordination complex oxidizer selected from coordination complexes comprised of anionic nitro and nitrito ligands coordinated with a transitional metal template, and a cationic component comprised of two or more different metals. The gas generant compositions generate relatively more gas and are significantly less toxic than known azide gas generant compositions, and furthermore, generate solids that are readily filterable.

18 Claims, No Drawings

GAS GENERANT COMPLEX OXIDIZERS

BACKGROUND OF THE INVENTION

The present invention relates to substantially nontoxic gas generating compositions which upon combustion, rapidly generate gases that are useful for inflating occupant safety restraints in motor vehicles and specifically, the invention relates to high nitrogen gas generants that produce combustion products having not only acceptable toxicity levels, but that also exhibit a relatively high gas volume to solid particulate ratio at acceptable flame temperatures.

Pyrotechnic gas generants incorporating an oxidizer such as potassium nitrate, potassium perchlorate, molybdenum disulfide, chromic chloride, copper oxide, or iron oxide with alkali metal and alkaline earth metal azides have been commercially successful. Sodium azide has been the most extensively used azide in solid gas generants for airbag systems as described in U.S. Pat. Nos. 2,981,616, 3,741,585, 3,865,660, 4,203,787, 4,547,235, and 4,758,287, the teachings of which are herein incorporated by reference.

However, azides are very toxic and sodium azide is a very poisonous material, both orally and dermatologically. In fact, sodium azide is shipped as a class B poison similar to other extremely toxic materials, such as sodium cyanide and strychnine. Sodium azide hydrolyzes, forming hydrazoic acid which is very poisonous and reacts with heavy metals such as copper and lead to form very sensitive covalent azides which are readily detonated by shock or impact. Furthermore, propellants prepared from sodium azide are not very efficient gas producers and result in gas outputs of only about 1.3 to 1.6 moles of gas per 100 grams of propellant.

The evolution from azide-based gas generants to nonazide gas generants is well-documented in the prior art. The advantages of nonazide gas generant compositions in comparison with azide gas generants have been extensively described in the patent literature, for example, U.S. Pat. Nos. 4,370,181; 4,909,549; 4,948,439; 5,084,118; 5,139,588 and 5,035,757, the discussions of which are herein incorporated by reference.

In addition to a fuel constituent, pyrotechnic gas generants contain ingredients such as oxidizers to provide the required oxygen for rapid combustion and reduce the quantity of toxic gases generated, a catalyst to promote the conversion of toxic oxides of carbon and nitrogen to innocuous gases, and a slag forming constituent to cause the solid and liquid products formed during and immediately after combustion to agglomerate into filterable clinker-like particulates. Other optional additives, such as burning rate enhancers or ballistic modifiers and ignition aids, are used to control the ignitability and combustion properties of the gas generant.

One of the disadvantages of known nonazide gas generant compositions is the amount and physical nature of the solid residues formed during combustion. The solid products must be filtered and otherwise kept away from contact with the occupants of the vehicle. It is therefore highly desirable to develop compositions that agglomerate any combustion solids formed and yet still providing adequate quantities of a nontoxic gas to inflate the safety device at a high rate. As such, the ability to form clinker-like particulates that are readily filtered is essential in preventing vehicle occupant exposure to any solids formed during combustion.

While known nonazide gas generants provide operable amounts of gas with a minimum of solid combustion products, in many cases, the mass of gas generant required compared to the mass of gas produced is still cause for concern. The volume of the inflator necessarily reflects the volume of gas generant required to produce the gas needed to deploy the inflator. A reduction in the volume of gas generant needed, or an increase in the moles of gas produced per gram of gas generant, would result in a desirable reduction in inflator volume thereby enhancing design flexibility.

DESCRIPTION OF THE RELATED ART

U.S. Pat. No. 5,160,386, to Lund et al, describes a gas generant having an oxidizer comprised of a polynitrito transition metal complex anion, and, a single metal cationic component selected from the group including alkali metal and alkaline earth metal ions.

U.S. Pat. No. 5,542,704, to Hamilton et al, describes the use of transition metal complexes of hydrazine such as zinc nitrate hydrazine for use in gas generant applications, wherein the oxidizer component is selected from inorganic alkali metal and inorganic alkaline earth metal nitrates and nitrites, and transition metal oxides. The coordination complexes comprise single metal cations.

Copending PCT application WO 95/19944, to Hinshaw et al, describes the use of carbon free gas generant compositions comprising metal cation coordination complexes and a neutral ligand containing hydrogen and nitrogen. When coordination complexes such as metal nitrite ammines, metal nitrate ammines, metal perchlorate ammines, and hydrazine coordination complexes are combusted, water vapor and nitrogen gas are the primary inflating products.

SUMMARY OF THE INVENTION

The aforementioned problems are solved by a gas generant for a vehicle passenger restraint system employing at least one metal nitro/nitrito coordination complex (hereinafter also referred to as a complex, coordination complex, nitro/nitrito complex, etc.) comprising a multimetal cation, and at least one nonazide fuel. The compositions of the present invention generate substantially nontoxic gases in amounts significantly greater and less toxic than known azide based gas generant compositions.

Coordination complex oxidizer compounds of the present invention are represented by the formula:

$$M'M''(NO_2)_z$$

wherein: (1) M' represents a multimetallic cationic component containing not less than two different metals and not more than four different metals selected from the group consisting of alkali, alkaline earth, and transitional metals from groups eleven and twelve of the periodic table (new IUPAC); (2) M" is at least one metal selected from the transition metals of Groups 4–12 of the Periodic Table; and (3) z=4 or 6 anionic nitrito/nitro ligands as determined by the required stoichiometry established by the metallic components of the coordination complex.

Coordination complexes of the present invention include, but are not limited to, disodium potassium hexanitrocobaltate (III), dipotassium barium hexanitronickelate (II), dipotassium sodium hexanitrocobaltate (III), dipotassium strontium hexanitrocuprate (II), and dipotassium strontium hexanitronickelate (II).

Although the components of the present invention have been described in their anhydrous form, it will be understood that the teachings herein encompass the hydrated forms as well.

DETAILED DESCRIPTION OF THE PREFERRED EMBODIMENTS

In accordance with the present invention, a gas generant composition comprises one or more coordination complex oxidizers which comprise a transition metal template, an anionic nitro or nitrito ligand coordinated to the template, and a multimetallic cation having two or more different metals. At least one nonazide fuel is combined with the complex. Multimetal cations, comprised of metals such as barium, calcium, and strontium, aid in the formation of readily filterable residual clinkers upon combustion.

Coordination complex oxidizer compounds of the present invention are represented by the formula:

$$M'M''(NO_2)_z$$

wherein: (1) M' represents a multimetallic cationic component containing not less than two different metals and not more than four different metals selected from the group consisting of alkali, alkaline earth, and transitional metals from groups eleven and twelve of the periodic table (new IUPAC); (2) M" is at least one metal selected from the transition metals of Groups 4–12 of the Periodic Table; and (3) z=4 or 6 anionic nitrito/nitro ligands as determined by the required stoichiometry established by the metallic components of the coordination complex.

Coordination complexes of the present invention include, but are not limited to, disodium potassium hexanitrocobaltate (III), dipotassium barium hexanitronickelate (II), dipotassium sodium hexanitrocobaltate (III), dipotassium strontium hexanitrocuprate (II), and dipotassium strontium hexanitronickelate (II).

A coordination complex is generally defined by what is formed when a central atom or ion, M, usually a metal, unites with one or more ligands, L, L', L", etc., to form a species of the type MLL'L". M, the ligands, and the resulting coordination complex may all bear charges. The coordination complex may be non-ionic, cationic, or anionic depending on the charges carried by the central atom and the coordinated groups. These groups are called ligands, and the total number of attachments to the central atom is called the coordination number. For example, cobalt (III) has a normal valence of three but in addition, an affinity for six groups, that is, a residual valence or coordination number of six. Other common names include complex ions (if electrically charged), Werner complexes, and coordination complexes.

To illustrate, a metal ammine complex is generally defined as a coordination complex in which the nitrogen atoms of ammonia are linked directly to the metal by coordinate covalent bonds. Coordinate covalent bonds are based on a shared pair of electrons, both of which come from a single atom or ion. Thus, in this case the coordination complex contains $NH_3$, ammonia, which is called a neutral ligand. In contrast to a neutral ligand, the coordination complexes of the present invention contain anionic ligands of a nitro or nitrito character. Nitro is used when the metal, M, is coordinated with the nitrogen atom of the nitrite group. Nitrito is used when M is coordinated with an oxygen atom of the nitrite group.

The multimetallic coordination complex(es) is employed in concentrations of 10 to 90%, and preferably 35 to 85%, by weight of the total gas generant composition.

A nonazide, high-nitrogen, low impact and low friction sensitivity fuel is combined with the coordination complex oxidizer. Nonazide fuels are selected from a group comprising azoles, tetrazoles, triazoles, and triazines; nonmetal and metal derivatives of tetrazoles, triazoles, and triazines; linear and cyclic nitramines of normal or fine particle size; and derivatives of guanidine, cyanoguanidine, hydrazine, hydroxylamine, and ammonia.

Examples of guanidine derivative fuels include, but are not limited to, guanidine compounds, either separately or in combination, selected from the group comprised of cyanoguanidine, metal and nonmetal derivatives of cyanoguanidine, guanidine nitrate, aminoguanidine nitrate, diaminoguanidine nitrate, triaminoguanidine nitrate (wetted or unwetted), guanidine perchlorate (wetted or unwetted), triaminoguanidine perchlorate (wetted or unwetted), aminonitroguanidine (wetted or unwetted), guanidine picrate, guanidine carbonate, triaminoguanidine picrate (wetted or unwetted), nitroguanidine (wetted or unwetted), nitroaminoguanidine (wetted or unwetted), metal salts of nitroaminoguanidine, metal salts of nitroguanidine, nitroguanidine nitrate, and nitroguanidine perchlorate.

Other high nitrogen nonazides employed as fuels in the gas generant compositions of this invention, either separately or in combination with the above described guanidine compounds, include oxamide, oxalyldihydrazide, triazines such as 2,4,6-trihydrazino-s-triazine (cyanurichydrazide), 2,4,6-triamino-s-triazine (melamine), and melamine nitrate; azoles such as urazole and aminourazole; tetrazoles such as tetrazole, azotetrazole, 1H-tetrazole, 5-aminotetrazole, 5-nitrotetrazole, 5-nitroaminotetrazole, 5,5'-bitetrazole, azobitetrazole, diguanidinium-5,5'-azotetrazolate, and diammonium 5,5'-bitetrazole; triazoles such as nitrotriazole, nitroaminotriazole, 3-nitro-1,2,4-triazole-5-one; and metallic and nonmetallic salts of the foregoing tetrazoles, triazoles, and triazines including manganese 5,5'-bitetrazole and zinc-5-aminotetrazole. The high nitrogen fuel generally comprises 5-70% by weight of the total gas generant composition.

An optional oxidizer compound is selected from a group comprising alkali metal, alkaline earth metal, transitional metal, and nonmetallic nitramides, cyclic nitramines, linear nitramines, caged nitramines, nitrates, nitrites, perchlorates, chlorates, chlorites, chromates, oxalates, halides, sulfates, sulfides, persulfates, peroxides, oxides, and combinations thereof. These include, for example, phase stabilized ammonium nitrate, ammonium nitrate, ammonium perchlorate, sodium nitrate, potassium nitrate, strontium nitrate, copper oxide, molybdenum disulfide, nitroguanidine, aminonitroguanidine, ammonium dinitramide, cyclotrimethylene trinitramine (RDX), and cyclotetramethylene tetranitramine (HMX). The oxidizer generally comprises 0–50% by weight of the total gas generant composition.

From a practical standpoint, the compositions of the present invention may include some of the additives heretofore used with gas generant compositions such as slag formers, compounding aids, ignition aids, ballistic modifiers, coolants, and NOX and Co scavenging agents.

Ballistic modifiers influence the temperature sensitivity and rate at which the gas generant or propellant burns. The ballistic modifier(s) is selected from a group comprising alkali metal, alkaline earth metal, transitional metal, organometallic, and/or ammonium, guanidine, and salts of cyanoguanidine; transition metal oxides and halides; sulfur; antimony trisulfide; chelates; metallocenes; ferrocenes; chromates, dichromates, trichromates, and chromites; and/or alkali metal, alkaline earth metal, guanidine, and triaminoguanidine borohydride salts; and/or transition metal salts of acetylacetone; either separately or in combinations thereof. Ballistic modifiers are employed in concentrations from about 0 to 25% by weight of the total gas generant composition.

The addition of a catalyst aids in reducing the formation of toxic carbon monoxide, nitrogen oxides, and other toxic species. A catalyst may be selected from a group comprising triazolates and/or tetrazolates; alkali, alkaline earth, and transition metal salts of tetrazoles, bitetrazoles, and triazoles; transition metal oxides; guanidine nitrate; nitroguanidine; aliphatic amines and aromatic amines; and mixtures thereof. A catalyst is employed in concentrations of 0 to 20% by weight of the total gas generant composition.

Even though a very low concentration of solid combustion products are formed when the pyrotechnic gas generant compositions of the present invention are ignited, the formation of solid klinkers or slags is desirable in order to prevent unwanted solid decomposition products from passing through or plugging up the filter screens of the inflator. In accordance with the present invention, the multimetal cations are selected to promote sufficient slag formation thereby inhibiting occupant exposure to any solids produced. If desired, other suitable slag formers and coolants may also be incorporated. They include lime, borosilicates, vycor glasses, bentonite clay, silica, alumina, silicates, aluminates, transition metal oxides, and mixtures thereof. A slag former is employed in concentrations of 0 to 10% by weight of the total gas generant composition.

An ignition aid controls the temperature of ignition, and is selected from the group comprising finely divided elemental sulfur, boron, carbon black, and/or magnesium, aluminum, titanium, zirconium, or hafnium metal powders, and/or transition metal hydrides, and/or transition metal sulfides, and the hydrazine salt of 3-nitro-1,2,4-triazole-5-one, in combination or separately. An ignition aid is employed in concentrations of 0 to 20% by weight of the total gas generant composition.

Processing aids are utilized to facilitate the compounding of homogeneous mixtures. Suitable processing aids include alkali, alkaline earth, and transition metal stearates; aqueous and/or nonaqueous solvents; molybdenum disulfide; graphite; boron nitride; polyethylene glycols; polypropylene carbonates; polyacetals; polyvinyl acetate; fluoropolymer waxes commercially available under the trade name "Teflon" or "Viton", and silicone waxes. The processing aid is employed in concentrations of 0 to 15% by weight of the total gas generant composition.

In accordance with the present invention, preparation of the multimetal coordination complexes described above is taught in several references, the entire teachings of which are herein incorporated by reference. The Encyclopedia of Explosives & Related Items, Volume 3, page C-386, PATR 2700, Picatinny Arsenal, Dover, N.J., 1966, describes the preparation of cobalt nitrite complexes. Comprehensive Coordination Chemistry, by Wilkinson et al., Section 47.4.2, by Pergamon Press, 1987, describes the preparation of nitro and nitrito complexes of cobalt; in Section 50.5.5.4, Wilkinson teaches the preparation of nitrito complexes of nickel. In the Coordination Chemistry Reviews, Volume 42, by Elsevier Scientific Publishing Company, Amsterdam, 1982, at pages 55–132, Hitchman and Rowbottom describe the coordination chemistry pertaining to transition metal nitrite complexes. Preparation techniques for multimetal complexes are taught in Mellors' Comprehensive Treatise on Inorganic and Theoretical Chemistry, Vol. VIII, (1928), pages 470–529, published by Longmans, Green, and Company. General preparation techniques of dipotassium barium hexanitronickelate and other nitrito/nitro nickelate complexes, are described within Inorganic Chemistry, Volume 3, by Goodman and Hitchman, at pages 1389–1394, 1964.

The manner and order in which the components of the gas generant compositions of the present invention are combined and compounded is not critical, so long as the proper particle size of ingredients are selected to ensure that desired mixture processing and ballistic properties are obtained. As known in the art, modification of particle size varies the burn rate. The compounding is performed by one skilled in the art, under proper safety procedures for the preparation of energetic materials, and under conditions which will not cause undue hazards in processing nor decomposition of the components employed. For example, the materials may be wet blended, or dry blended and attrited in a ball mill or Red Devil type paint shaker and then pelletized by compression molding. The materials may also be ground separately or together in a fluid energy mill, sweco vibroenergy mill or bantam micropulverizer and then blended or further blended in a v-blender prior to compaction.

Compositions having components more sensitive to friction, impact, and electrostatic discharge should be wet ground separately followed by drying. The resulting fine powder of each of the components may then be wet blended by tumbling with ceramic cylinders in a ball mill jar, for example, and then dried. Less sensitive components may be dry ground and dry blended at the same time.

When formulating a composition, the ratio of oxidizer to fuel, wherein the metal coordination complex functions as the oxidizer, is adjusted such that the oxygen balance is between −10.0% and +10.0% $O_2$ by weight of composition as described above. More preferably, the ratio of oxidizer to fuel is adjusted such that the composition oxygen balance is between −4.0% and 1.0% $O_2$ by weight of composition. Most preferably, the ratio is between −2.0% and 0.0% by weight of composition. The oxygen balance is the weight percent of $O_2$ in the composition which is needed or liberated to form the stoichiometrically balanced products. Therefore, a negative oxygen balance represents an oxygen deficient composition whereas a positive oxygen balance represents an oxygen rich composition. It can be appreciated that the relative amounts of oxidizer and fuel will depend on the nature of the selected coordination complex.

The present invention is illustrated by the following examples wherein the components are quantified in weight percent of the total composition unless otherwise stated. Theoretical values of the products are obtained based on the given compositions.

Example 1

Disodium Potassium Hexanitrocobaltate (III)/ Guanidine Nitrate $$KNa_2Co(NO_2)_6+4CH_6N_4O_3 \rightarrow \tfrac{1}{2}K_2O+Na_2O+CoO+12H_2O+4CO_2+11N_2+\tfrac{3}{4}O_2$$

A mixture of 46.26% $KNa_2Co(NO_2)_6$ and 53.74% $CH_6N_4O_3$ is prepared. The components are separately ground to a fine powder by tumbling with ceramic cylinders in a ball mill jar. The powder is then separated from the grinding cylinders and granulated to improve the flow characteristics of the material. Next, the ground components are cautiously blended in a v-blender prior to compaction. The homogeneously blended granules are then compression molded into pellets on a high speed rotary press. Pellets formed by this method are of acceptable quality and strength. The combustion products include 33.92% $N_2$ (g), 2.64% $O_2$ (g), 19.38% $CO_2$, 23.79% $H_2O$ (v), 5.18% $K_2O$, 6.83% $Na_2O$, and 8.26% CoO (s). The moles/100 gms of gas generant for each of these end products, respectively, is 1.211M, 0.083M, 0.440M, 1.322M, 0.055M, 0.110M and 0.110M. The total weight percent of gaseous and vapor products is 79.73%. The total gaseous and vapor moles/100 g of gas generant is 3.056.

Example 2

Dipotassium Barium Hexanitronickelate (II)/ Guanidine Nitrate

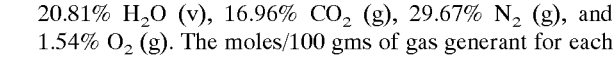

$$K_2BaNi(NO_2)_6+4CH_6N_4O_3 \rightarrow K_2O+BaO+NiO+12H_2O+4CO_2+11N_2\tfrac{1}{2}O_2$$

A mixture of 52.99% $K_2BaNi(NO_2)_6$ and 47.01% $CH_6N_4O_3$ is prepared as in Example 1. The end products include 9.06% $K_2O$ (s), 14.73% BaO (s), 7.23% NiO (s), 20.81% $H_2O$ (v), 16.96% $CO_2$ (g), 29.67% $N_2$ (g), and 1.54% $O_2$ (g). The moles/100 gms of gas generant for each of these end products, respectively, is 0.096M, 0.096M, 0.096M, 1.156M, 0.385M, 1.060M and 0.048M. The total weight percent of gaseous and vapor products is 68.98%. The total gaseous and vapor moles/100 g of gas generant is 2.649.

Example 3

Dipotassium Sodium Hexanitrocobaltate (III)/5-Aminotetrazole

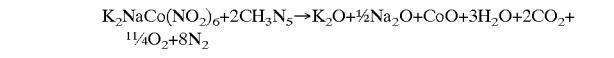

$$K_2NaCo(NO_2)_6+2CH_3N_5 \rightarrow K_2O+\tfrac{1}{2}Na_2O+CoO+3H_2O+2CO_2+\tfrac{11}{4}O_2+8N_2$$

A mixture of 71.95% $K_2NaCo(NO_2)_6$ and 28.05% $CH_3N_5$ is prepared as in Example 1. The end products include 15.51% $K_2O$ (s), 5.11% $Na_2O$ (s), 12.38% CoO (s), 8.92% $H_2O$ (v), 14.52% $CO_2$ (g), 6.60% $O_2$ (g), and 36.96% $N_2$ (g). The moles/100 gms of gas generant for each of these end products, respectively, is 0.165M, 0.083M, 0.165M, 0.495M, 0.330M, 0.206M and 1.320M. The total weight percent of gaseous and vapor products is 67.00%. The total gaseous and vapor moles/100 g of gas generant is 2.351.

Example 4

Dipotassium Strontium Hexanitrocuprate (II)/ Ammonium 5,5'-Bitetrazole

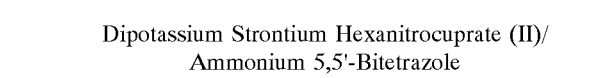

$$K_2SrCu(NO_2)_6+(NH_4)_2C_2N_8 \rightarrow K_2O+SrO+CuO+4H_2O+2CO_2+8N_2+\tfrac{1}{2}O_2$$

A mixture of 74.63% $K_2SrCu(NO_2)_6$ and 25.37% $(NH_4)_2C_2N_8$ is prepared as in Example 1. The end products include 13.86% $K_2O$ (s), 15.34% SrO (s), 11.80% CuO (s), 10.62% $H_2O$ (v), 12.98% $CO_2$ (g), 33.04% $N_2$ (g), and 2.36% $O_2$ (g). The moles/100 gms of gas generant for each of these end products, respectively, is 0.147M, 0.147M, 0.147M, 0.590M, 0.295M, 1.180M and 0.074M. The total weight percent of gaseous and vapor products is 59.00%. The total gaseous and vapor moles/100 g of gas generant is 2.139.

Example 5

Dipotassium Strontium Hexanitronickelate (II)/5-Aminotetrazole

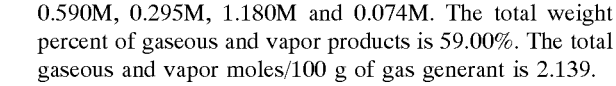

$$K_2SrNi(NO_2)_6+2CH_3N_5 \rightarrow K_2O+SrO+NiO+3H_2O+2CO_2+O_2+8N_2$$

A mixture of 74.66% $K_2SrNi(NO_2)_6$ and 25.34% $CH_3N_5$ is prepared as in Example 1. The end products include 14.00% $K_2O$ (s), 15.5% SrO (s), 11.18% NiO (s), 8.06% $H_2O$ (v), 13.11% $CO_2$ (g), 4.77% $O_2$ (g), and 33.38% $N_2$ (g). The moles/100 gms of gas generant for each of these end products, respectively, is 0.149M, 0.149M, 0.149M, 0.448M, 0.298M, 0.149M and 1.192M. The total weight percent of gaseous and vapor products is 59.32%. The total gaseous and vapor moles/100 g of gas generant is 2.087.

While the foregoing examples illustrate and describe the use of the present invention, they are not intended to limit the invention as disclosed in certain preferred embodiments herein. Therefore, variations and modifications commensurate with the above teachings and the skill and/or knowledge of the relevant art, are within the scope of the present invention.

I claim:

1. A gas generant composition, hydrated or anhydrous, useful for inflating an automotive air bag passive restraint system, comprising a nonazide fuel and a coordination complex oxidizer, wherein said nonazide fuel is selected from the group consisting of urazoles, tetrazoles, triazoles, triazines, and derivatives of guanidine, and said coordination complex oxidizer comprises an inorganic compound having a polynitro transition metal complex anion, said coordination complex oxidizer being selected from the group consisting of disodium potassium hexanitrocobaltate (III), dipotassium barium hexanitrocobaltate (II), dipotassium sodium hexanitrocobaltate (III), and dipotassium strontium hexanitrocobaltate (II).

2. The composition of claim 1 comprising disodium potassium hexanitrocobaltate (III) and guanidine nitrate.

3. The composition of claim 1 comprising dipotassium barium hexanitronickelate (II) and guanidine nitrate.

4. The composition of claim 1 comprising dipotassium sodium hexanitrocobaltate (III) and 5-aminotetrazole.

5. The composition of claim 1 comprising dipotassium strontium hexanitrocuprate (II) and ammonium 5,5'-bitetrazole.

6. The composition of claim 1 comprising dipotassium strontium hexanitronickelate (II) and 5-aminotetrazole.

7. The composition of claim 1 wherein said coordination complex is employed in a concentration of 10–90% by weight of the total composition and said nonazide fuel is employed in a concentration of 5–70% by weight of the total composition.

8. The composition of claim 1 wherein said guanidine derivative is selected from the group consisting of guanidine nitrate, aminoguanidine nitrate, diaminoguanidine nitrate, triaminoguanidine nitrate (wetted or unwetted), guanidine perchlorate (wetted or unwetted), triaminoguanidine perchlorate (wetted or unwetted), guanidine picrate (wetted or unwetted), triaminoguanidine picrate (wetted or unwetted), nitroguanidine (wetted or unwetted), nitroaminoguanidine (wetted or unwetted), metal salts of nitroaminoguanidine, metal salts of nitroguanidine, nitroguanidine nitrate, nitroguanidine perchlorate, and mixtures thereof.

9. The composition of claim 1 wherein said urazoles, tetrazoles, and tetrazole derivatives are selected from a group consisting of urazole, aminourazole, tetrazole, azotetrazole, 1H-tetrazole, 5-aminotetrazole, 5-nitrotetrazole, 5-nitroaminotetrazole, 5,5'-bitetrazole, manganese 5,5'-bitetrazole, azobitetrazole, diguanidinium-5,5'-azotetrazolate, diammonium 5,5'-bitetrazole, metal and nonmetal salts of said tetrazoles, and mixtures thereof.

10. The composition of claim 1 wherein said triazoles, triazines, and derivatives thereof are selected from the group consisting of 2,4,6-trihydrazino-s-triazine, 2,4,6-triamino-s-triazine, melamine nitrate, triazole, nitrotriazole, nitroaminotriazole, 3-nitro-1,2,4-triazole-5-one, metallic and nonmetallic salts of said triazoles and triazines, and mixtures thereof.

11. The composition of claim 1 further comprising at least one additional oxidizer compound selected from the group consisting of linear and cyclic nitramines; and, alkali metal, alkaline earth metal, transitional metal and nonmetallic nitrates, nitrites, perchlorates, chlorates, chlorites, chromates, oxalates, halides, sulfates, sulfides, persulfates, peroxides, oxides, nitramides, and mixtures thereof.

12. The composition of claim 11 wherein said additional oxidizer compound is employed in a concentration of 0.1–50% by weight of the total composition.

13. The composition of claim 11 wherein said additional oxidizer compound is selected from the group consisting of phase stabilized ammonium nitrate, ammonium nitrate, ammonium perchlorate, sodium nitrate, potassium nitrate, strontium nitrate, copper oxide, molybdenum disulfide, nitroguanidine, ammonium dinitramide, and mixtures thereof.

14. The composition of claim 1 further comprising a ballistic modifier selected from the group consisting of organometallic compounds selected from the group consisting of metallocenes and chelates of metals, and metal chromium salts, the metal being selected from Groups 1–14 of the Periodic Table of Elements; elemental sulfur and mixtures thereof, employed in a concentration of 0.1 to 25% by weight of the total gas generant.

15. The composition of claim 1 further comprising an inert slag former and coolant selected from the group consisting of lime, borosilicates, vycor glasses, bentonite clay, silica, diatomaceous earth, alumina, silicates, aluminates, and mixtures thereof, employed in a concentration of 0.1 to 10% by weight of the total gas generant composition.

16. The composition of claim 1 further comprising a catalyst selected from the group consisting of alkali metal, alkaline earth metal and transition metal salts of bitetrazoles, and mixtures thereof, employed in a concentration of 0.1 to 20% by weight of the total gas generant composition.

17. The composition of claim 1 further comprising an ignition aid selected from the class consisting of boron, carbon black, magnesium, aluminum, titanium, zirconium, hafnium, transition metal hydrides, and mixtures thereof, employed in a concentration of 0.1 to 20% by weight of the gas generant.

18. The composition of claim 1 further comprising a processing aid selected from the group consisting of graphite; boron nitride; alkali, alkaline earth, and transition metal stearates; polyethylene glycols; polypropylene carbonates; lactose; polyacetals; polyvinyl acetates; polycarbonates; polyvinyls; alcohols; fluoropolymers; paraffins; silicone waxes; and mixtures thereof, employed in a concentration of 0.1 to 15% by weight of the gas generant.

* * * * *